US012122431B2

(12) United States Patent
Gillis

(10) Patent No.: US 12,122,431 B2
(45) Date of Patent: Oct. 22, 2024

(54) ASYMMETRIC HOPPER CARS

(71) Applicant: Gunderson LLC, Portland, OR (US)

(72) Inventor: Michael Gillis, Portland, OR (US)

(73) Assignee: Gunderson LLC, Lake Oswego, OR (US)

( * ) Notice: Subject to any disclaimer, the term of this patent is extended or adjusted under 35 U.S.C. 154(b) by 126 days.

(21) Appl. No.: 17/326,568

(22) Filed: May 21, 2021

(65) Prior Publication Data

US 2021/0362752 A1 Nov. 25, 2021

Related U.S. Application Data

(60) Provisional application No. 63/028,707, filed on May 22, 2020.

(51) Int. Cl.

| | |
|---|---|
| ***B61D 7/14*** | (2006.01) |
| ***B61D 7/02*** | (2006.01) |
| ***B61D 7/16*** | (2006.01) |
| ***B61D 17/04*** | (2006.01) |
| ***B61D 17/06*** | (2006.01) |
| ***B61D 17/08*** | (2006.01) |

(52) U.S. Cl.

CPC ..... *B61D 7/14* (2013.01); *B61D 7/02* (2013.01); *B61D 7/16* (2013.01); *B61D 17/048* (2013.01); *B61D 17/06* (2013.01); *B61D 17/08* (2013.01)

(58) Field of Classification Search

CPC ... B61D 7/00; B61D 7/02; B61D 7/14; B61D 7/16; B61D 17/04; B61D 17/043; B61D 17/048; B61D 17/06; B61D 17/08; B61D 49/00

See application file for complete search history.

(56) References Cited

U.S. PATENT DOCUMENTS

| | | | | | |
|---|---|---|---|---|---|
| 401,530 | A * | 4/1889 | Zurcher | B61D 7/02 | 105/407 |
| 1,422,133 | A * | 7/1922 | Robider | B61D 7/02 | 105/247 |
| 3,427,994 | A * | 2/1969 | Keene | B61D 7/02 | 105/248 |
| 4,230,048 | A * | 10/1980 | Gordon | B61D 7/00 | 105/248 |
| 4,352,331 | A * | 10/1982 | Anderson | B61D 7/14 | 406/138 |

(Continued)

*Primary Examiner* — Zachary L Kuhfuss
*Assistant Examiner* — Cheng Lin
(74) *Attorney, Agent, or Firm* — Chernoff, Vilhauer, McClung, & Stenzel, LLP

(57) ABSTRACT

Railroad hopper cars and methods of increasing total volume capacity of a railroad hopper car having a car body with two or more hoppers. In one embodiment, the railroad hopper car includes a car body having a pair of opposed sides and a pair of opposed ends defining a length. The hopper car additionally includes a pair of wheeled trucks supporting the car body. The hopper car further includes two or more spaced bulkheads extending between the pair of opposed sides to define three or more separate hoppers arranged adjacent one another along the length of the car body and between the pair of side walls. The hoppers being longitudinally asymmetric such that total volume of the hoppers on one side of a transverse center plane of the car body is different from total volume of the hoppers on the other side of the transverse center plane.

12 Claims, 13 Drawing Sheets

(56) References Cited

U.S. PATENT DOCUMENTS

| | | | | |
|---|---|---|---|---|
| 4,353,312 | A | 10/1982 | Brouwer | |
| 4,608,931 | A * | 9/1986 | Ruhmann | B61D 17/005 105/248 |
| 4,696,088 | A | 9/1987 | Miller | |
| 4,696,237 | A | 9/1987 | Miller | |
| 4,898,101 | A * | 2/1990 | Harter | B61D 7/02 105/247 |
| 6,227,124 | B1 | 5/2001 | Gaydos et al. | |
| 6,502,518 | B1 | 1/2003 | Miller | |
| 7,536,957 | B2 * | 5/2009 | Bush | B61D 7/00 105/247 |
| 7,703,397 | B2 * | 4/2010 | Forbes | B61D 7/02 105/282.2 |
| 7,861,659 | B2 * | 1/2011 | Gillis | B61F 1/02 105/247 |
| 7,908,975 | B2 * | 3/2011 | Forbes | B61D 7/02 105/247 |
| 9,789,801 | B2 | 10/2017 | Maertens et al. | |
| 2010/0011987 | A1 | 1/2010 | Forbes | |

* cited by examiner

ASYMMETRIC HOPPER CARS

CROSS REFERENCE TO RELATED APPLICATIONS

This application claims the benefit of U.S. Provisional Patent Application Ser. No. 63/028,707 filed May 22, 2020 and entitled "Asymmetric Hopper Car." The complete disclosure of the above application is hereby incorporated by reference for all purposes.

BACKGROUND OF THE INVENTION

The present invention is directed to both asymmetric hopper cars and methods of constructing such hopper cars starting from a hopper car with a different volume, such as constructing a 4,251 cubic foot asymmetric hopper car or a 4,751 cubic foot asymmetric hopper car from a 3,250 cubic foot hopper car.

A number of years ago, there was a boom in the rail industry for 3,250 cubic foot hopper cars, where the cars were used to carry high density materials such as frack sand in the fracking industry. While demand was high for these cars at the time, eventually demand decreased as more efficient methods for fracking were developed. This change in the industry left a lot of the already manufactured cars with limited use. While these cars are also used to ship powdered cement and other dense materials, the demand remains nowhere close to absorb the excess inventory of these type of cars. With the recent drop in oil prices this year, demand has dropped even further. Given that a hopper car can have a useful life of around four decades, there is existing stock of all types of hopper cars that do not match the current needs of the economy.

What is desired, therefore, is a way to convert these existing hopper cars to other useful service, to keep up with the changes in the industry and reduce manufacturing surplus of these type of cars.

BRIEF DESCRIPTION OF THE DRAWINGS

For a better understanding of the invention, and to show how the same may be carried into effect, reference will now be made, by way of example to the accompanying drawings, which.

DETAILED DESCRIPTION OF PREFERRED EMBODIMENTS

Figure 1:
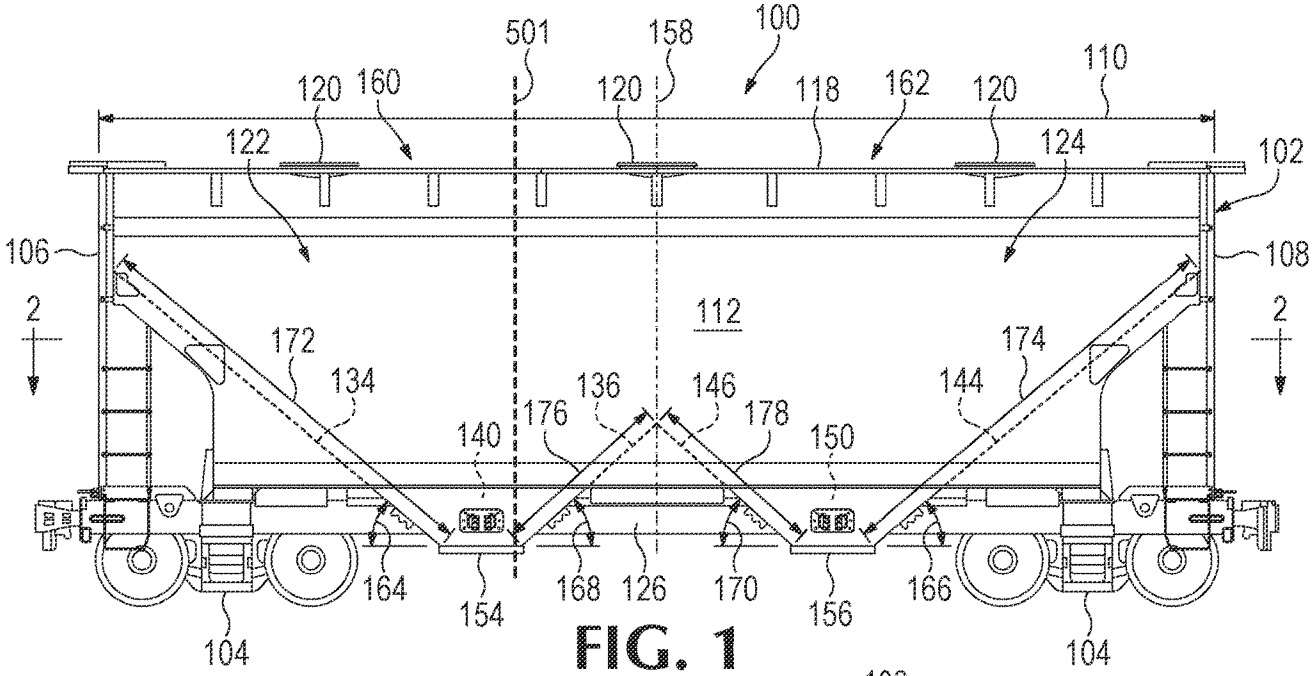
FIG. 1 shows a side view of an illustrative example of a symmetrical hopper car.
Figure 2:
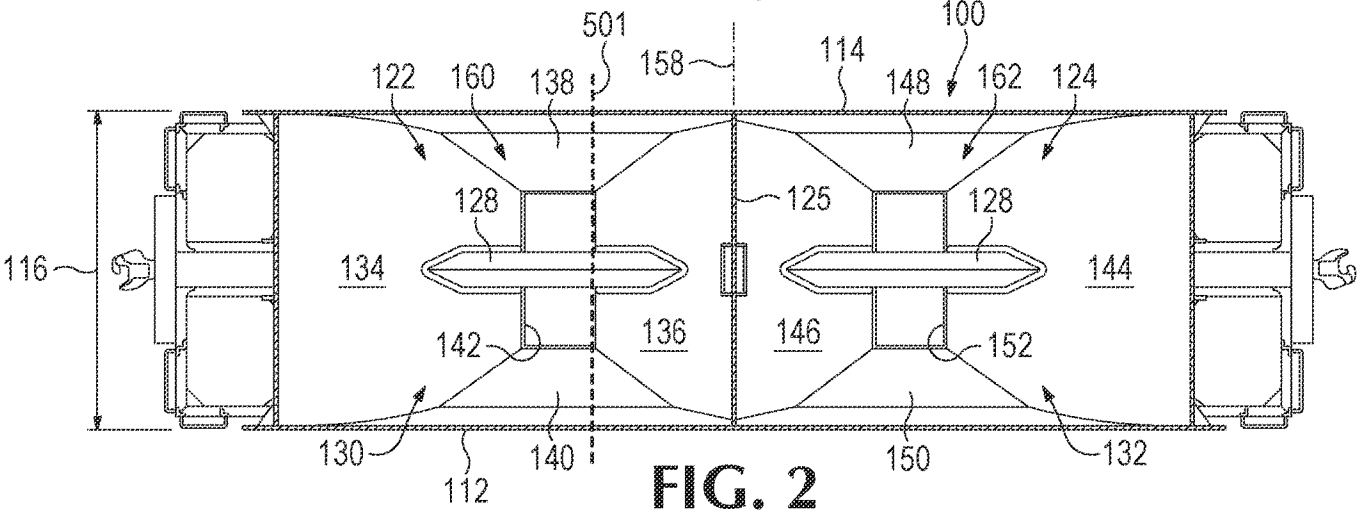
FIG. 2 shows a sectional view of the hopper car of FIG. 1 taken along lines 2-2 in FIG. 1.

Referring now to the drawings that form a portion of the disclosure herein, FIGS. 1-2 show an example of a symmetrical covered hopper car 100. Unless explicitly stated, covered hopper car 100 may include one or more of the same or substantially similar components as one or more of the other covered hopper cars in the present disclosure. The hopper car includes a car body 102 carried on a pair of wheeled trucks 104 and having a pair of opposed ends 106 and 108 defining a length 110. A pair of opposite sides 112 and 114 define a width 116 of the car. A roof 118 is attached to and supported by ends 106 and 108 and sides 112 and 114. Roof 118 may include hatches 120 for providing access to, for example, two separate cargo hoppers 122 and 124 within car body 102. A transversely-extending bulkhead 125 extends between sides 112 and 114, separating cargo hoppers 122 and 124 from each other.

A center sill 126 may extend through the entire length of the car body, and appropriate protective structure 128 (such as a center hood) may extend along the top of center sill 126 within each hopper to ensure that cargo is free to slide out of each hopper, rather than being able to remain atop center sill 126 when the hopper is emptied.

Cargo hoppers 122 and 124 include bottom portions 130 and 132, respectively. Bottom portion 130 of cargo hopper 122 includes an end slope sheet 134, an opposed intermediate slope sheet 136, and opposed transverse sheets 138 and 140, the ends of which collectively define a hopper outlet 142. Similarly, bottom portion 132 of cargo hopper 124 includes an end slope sheet 144, an opposed intermediate slope sheet 146, and opposed transverse sheets 148 and 150, the ends of which collectively define a hopper outlet 152. Gate frames 154 and 156 support and at least partially surround hopper outlets 142 and 152.

When covered hopper car 100 is divided mid-way or halfway along its length, such as via an imaginary transverse center plane 158, hopper car 100 is symmetrical or longitudinally symmetrical. For example, volume of cargo that can be carried on a side 160 of transverse center plane 158 is the same (or substantially the same) as the volume of cargo that can be carried on other side 162 of that plane. In the example shown in FIGS. 1-2, transverse center plane 158 is along bulkhead 125 and separates cargo hopper 122 on side 160 and cargo hopper 124 on side 162.

Additionally, the geometry of the hopper cars on sides 160 and 162 are symmetrical (or longitudinally symmetrical) to each other. For example, end slope sheet 134 has an angle of inclination (from horizontal) 164 that is the same (or substantially the same) as an angle of inclination 166 of end slope sheet 144. For example, the angle of inclination for both end slope sheets may be 40 degrees. Moreover, intermediate slope sheets 136 and 146 have angles of inclination 168 and 170, respectively, that are the same (or substantially the same) as each other, such as 42 degrees. Furthermore, end slope sheets 134 and 144 have lengths 172 and 174, respectively, that are the same (or substantially the same) as each other, such as 14 feet and 7⅛ inches. Additionally, intermediate slope sheets 136 and 146 have lengths 176 and 178, respectively, that are the same (or substantially the same) as each other, such as 6 feet and 5¾ inches. Side 160 may thus sometimes be referred to as being a mirror image of side 162, or vice versa at least as it relates to the end slope sheets, intermediate slope sheets, and/or transverse sheets in those sides.

Figure 3:
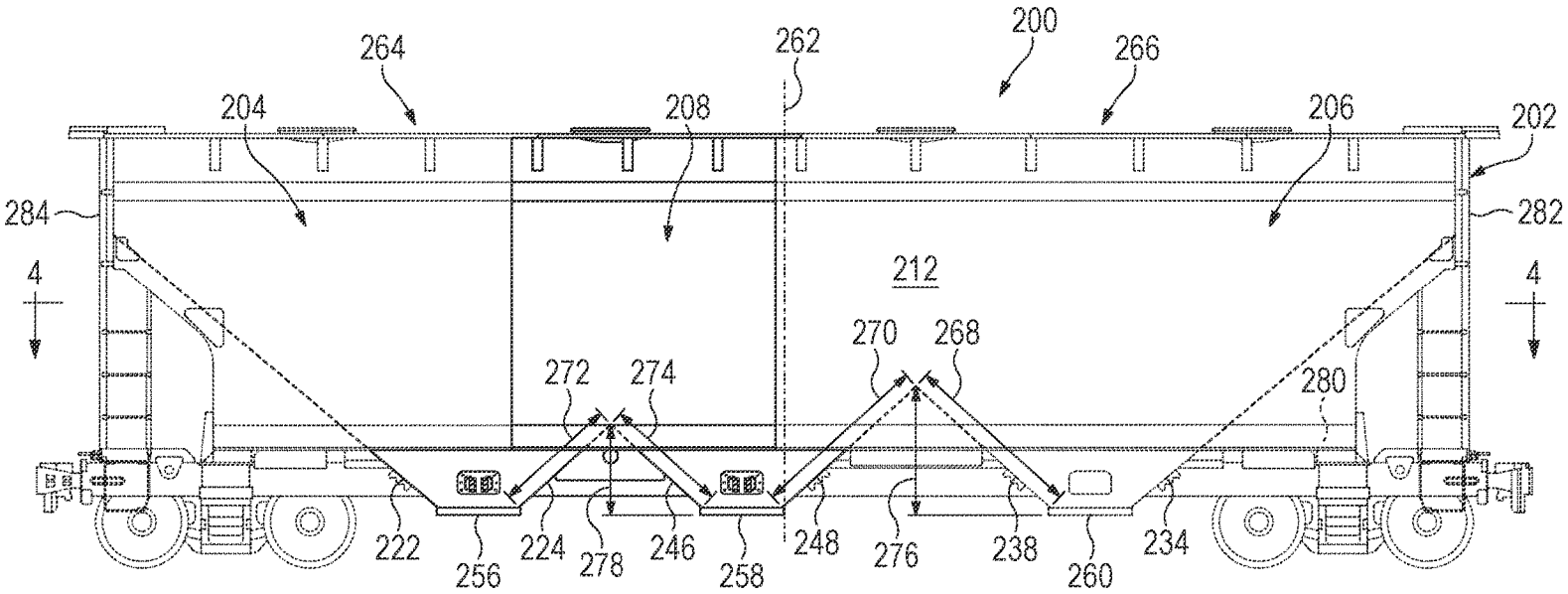
FIG. 3 shows a side view of an illustrative example of an asymmetrical hopper car.
Figure 4:
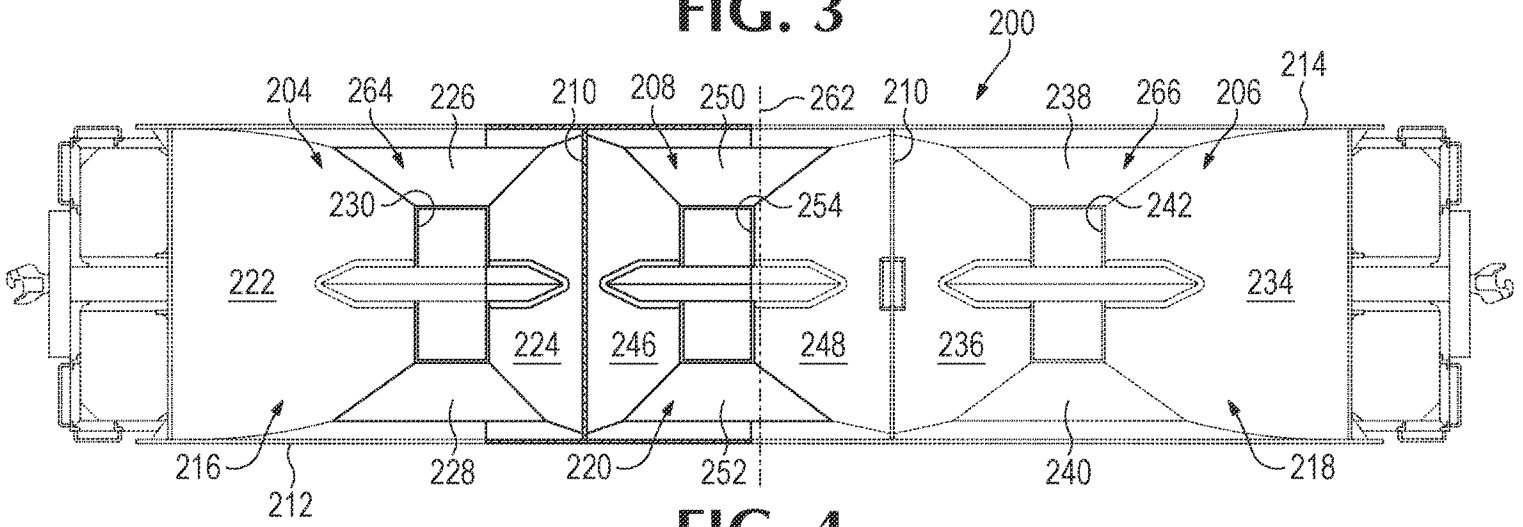
FIG. 4 shows a sectional view of the hopper car of FIG. 3 taken along lines 4-4 in FIG. 3.

Referring to FIGS. 3-4, an asymmetrical covered hopper car 200 is shown. Unless explicitly stated, covered hopper car 200 may include one or more of the same or substantially similar components as one or more of the other covered hopper cars in the present disclosure. Unlike covered hopper car 100, hopper car 200 includes three separate cargo hoppers within car body 202, namely two end hoppers 204 and 206 and an intermediate hopper 208 disposed therebetween. A pair of transversely-extending bulkheads 210 extend between sides 212 and 214, separating cargo hoppers 204, 206, and 208 from each other.

Cargo hoppers 204, 206, and 208 include bottom portions 216, 218, and 220, respectively. Bottom portion 216 of cargo hopper 204 includes an end slope sheet 222, an opposed intermediate slope sheet 224, and opposed transverse sheets 226 and 228, the ends of which collectively define a hopper outlet 230. Similarly, bottom portion 218 of cargo hopper 206 includes an end slope sheet 234, an opposed intermediate slope sheet 236, and opposed transverse sheets 238 and 240, the ends of which collectively define a hopper outlet 242. Additionally, bottom portion 220 includes opposed intermediate slope sheets 246 and 248 and opposed transverse sheets 250 and 252, which collectively define a hopper outlet 254. Gate frames 256, 258, and 260 support and at least partially surround hopper outlets 230, 242, and 254.

Unlike cover hopper car 100, when covered hopper car 200 is divided mid-way or halfway along its length, such as via an imaginary transverse center plane 262, hopper car 200 is asymmetrical. For example, volume of cargo that can be carried on a side 264 of transverse center plane 262 is larger than the volume of cargo that can be carried on other side 266 of that plane (e.g., 2,084 cu. ft. and 2,167 cu. ft., respectively). In the example shown in FIGS. 3-4, side 264 includes end cargo hopper 204 and a substantial portion of intermediate cargo hopper 208, and side 266 includes end cargo hopper 206 and the remaining portion of intermediate cargo hopper 208.

Additionally, the geometry of the hopper cars on sides 264 and 266 are asymmetrical to each other. For example, intermediate slope sheets 236 and 248 have lengths 268 and 270, respectively, that are the same (or substantially the same) as each other, such as 6 feet and 5¾ inches but are larger than lengths 272 and 274 of intermediate slope sheets 224 and 246 (e.g., 4 feet and 4 inches). This results in intermediate slope sheets 224 and 246 having an effective height 276 (e.g., 4 feet and 5 inches) that is larger than an effective height 278 (e.g., 3 feet) of intermediate slope sheets 236 and 248. In the example shown in FIGS. 3-4, the angles of inclination of the end slope sheets are the same as each other (e.g., 40 degrees) and the angles of inclination of the intermediate slope sheets are the same as each other (e.g., 42 degrees). However, other embodiments of hopper car 200 may include different angles of inclination.

Figure 5:
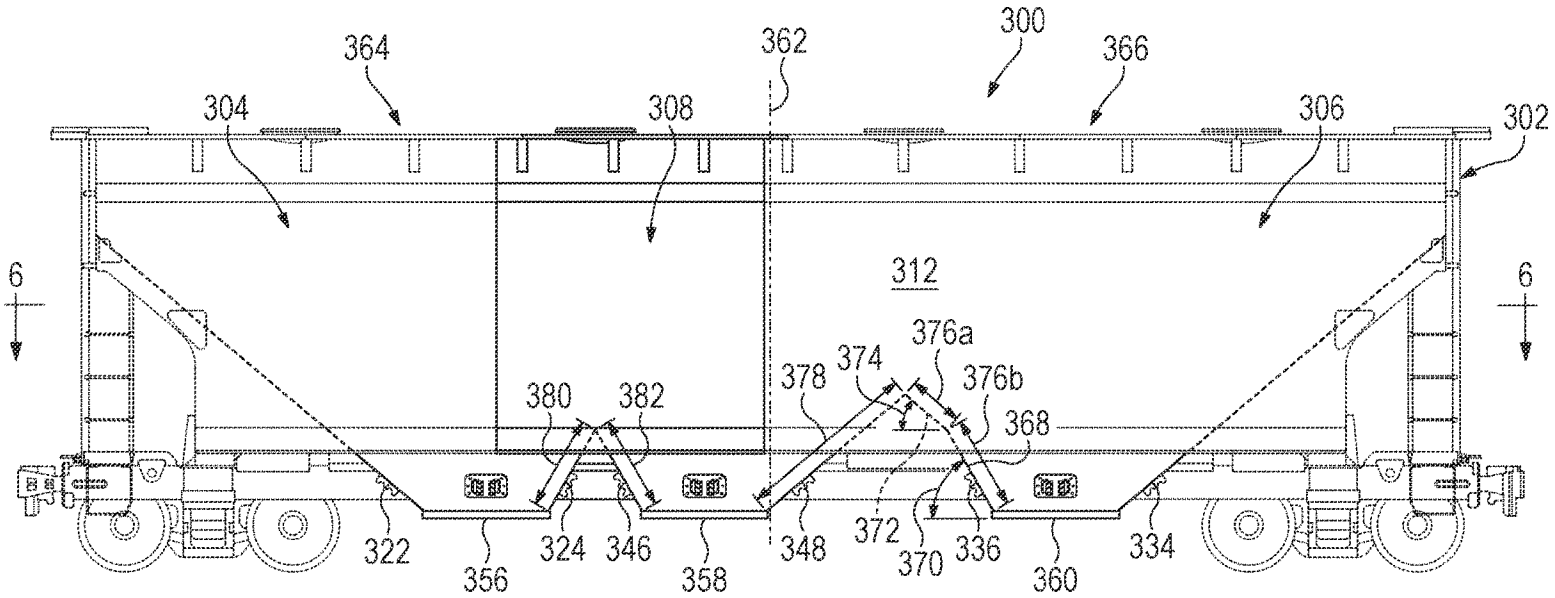
FIG. 5 shows a side view of another example of an asymmetrical hopper car.
Figure 6:
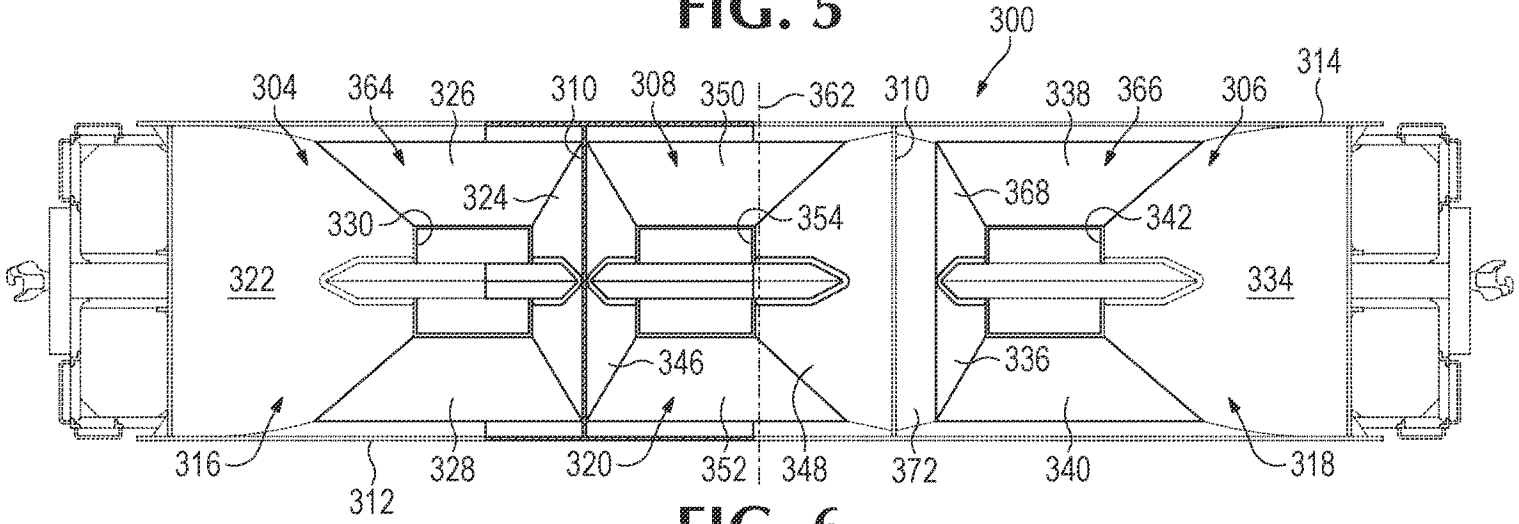
FIG. 6 shows a sectional view of the hopper car of FIG. 5 taken along lines 6-6 in FIG. 5.

Referring to FIGS. 5-6, another asymmetrical covered hopper car 300 is shown. Unless explicitly stated, covered hopper car 300 may include one or more of the same or substantially similar components as one or more of the other covered hopper cars in the present disclosure. Similar to covered hopper car 200, hopper car 300 includes three separate cargo hoppers within car body 302, namely two end hoppers 304 and 306 and an intermediate hopper 308 disposed therebetween. The volume capacity of hopper cars 200 and 300 are the same or substantially the same as each other. However, the hopper outlets and associated gates of those hoppers are larger than the hopper outlets in hopper car 200. A pair of transversely-extending bulkheads 310 extend between sides 312 and 314, separating cargo hoppers 304, 306, and 308 from each other.

Cargo hoppers 304, 306, and 308 include bottom portions 316, 318, and 320, respectively. Bottom portion 316 of cargo hopper 304 includes an end slope sheet 322, an opposed intermediate slope sheet 324, and opposed transverse sheets 326 and 328, the ends of which collectively define a hopper outlet 330. Similarly, bottom portion 318 of cargo hopper 304 includes an end slope sheet 334, an opposed intermediate slope sheet 336, and opposed transverse sheets 338 and 340, the ends of which collectively define a hopper outlet 342. Additionally, bottom portion 320 includes opposed intermediate slope sheets 346 and 348 and opposed transverse sheets 350 and 352, which collectively define a hopper outlet 354. Gate frames 356, 358, and 360 support and at least partially surround hopper outlets 330, 342, and 354.

Similar to covered hopper car 200, when covered hopper car 300 is divided mid-way or halfway along its length, such as via an imaginary transverse center plane 362, hopper car 300 is asymmetrical. For example, volume of cargo that can be carried on a side 364 of transverse center plane 362 is larger than the volume of cargo that can be carried on other side 366 of that plane (e.g., 2171 cu. ft. and 2080 cu. ft., respectively). In the example shown in FIGS. 4-5, side 364 includes end cargo hopper 304 and a substantial portion of intermediate cargo hopper 308, and side 366 includes end cargo hopper 306 and the remaining portion of intermediate cargo hopper 308 (i.e., the portion not on side 362).

Additionally, the geometry of the hopper cars on sides 364 and 366 are asymmetrical to each other. For example, intermediate slope sheet 336 may have two angles of inclination. A substantial part 368 of intermediate slope sheet 336 may have a first angle of inclination 370, and the remainder part 372 of intermediate slope sheet 336 may have a second angle of inclination 374 that is different from first angle of inclination 370. In the example shown in FIGS. 5-6, first angle of inclination 370 (e.g., 60 degrees) is larger than second angle of inclination 374 (e.g., 42 degrees). The second angle of inclination of remainder part 372 may be the same or different than the angles of inclination of the other intermediate slope sheets, namely intermediate slope sheets 324, 346, and 348. For example, the angles of inclination for intermediate slope sheets 324, 346, and 348 are 60, 60, and 42 degrees, respectively.

Moreover, intermediate slope sheets 336 and 348 have lengths 376 and 378, respectively, that are different from each other, such as 5 feet, 5⅝ inches and 6 feet, 5¾ inches, respectively. Length 376 is the sum of lengths **376*a* and 376*b* of substantial part 368 and remainder part 372, respectively (e.g., 1 foot and 10 15/16 inches and 3 feet and 6 feet and 11/16 inches, respectively). One or more both lengths 376 and 378 may be larger than lengths 380 and 382 of intermediate slope sheets 324 and 346 (e.g., 3 feet, 5 11/16 inches and 3 feet, 5 11/16 inches, respectively). In the example shown in FIGS. 5-6**, the angles of inclination of the end slope sheets are the same as each other (e.g., 40 degrees).

Figure 7:
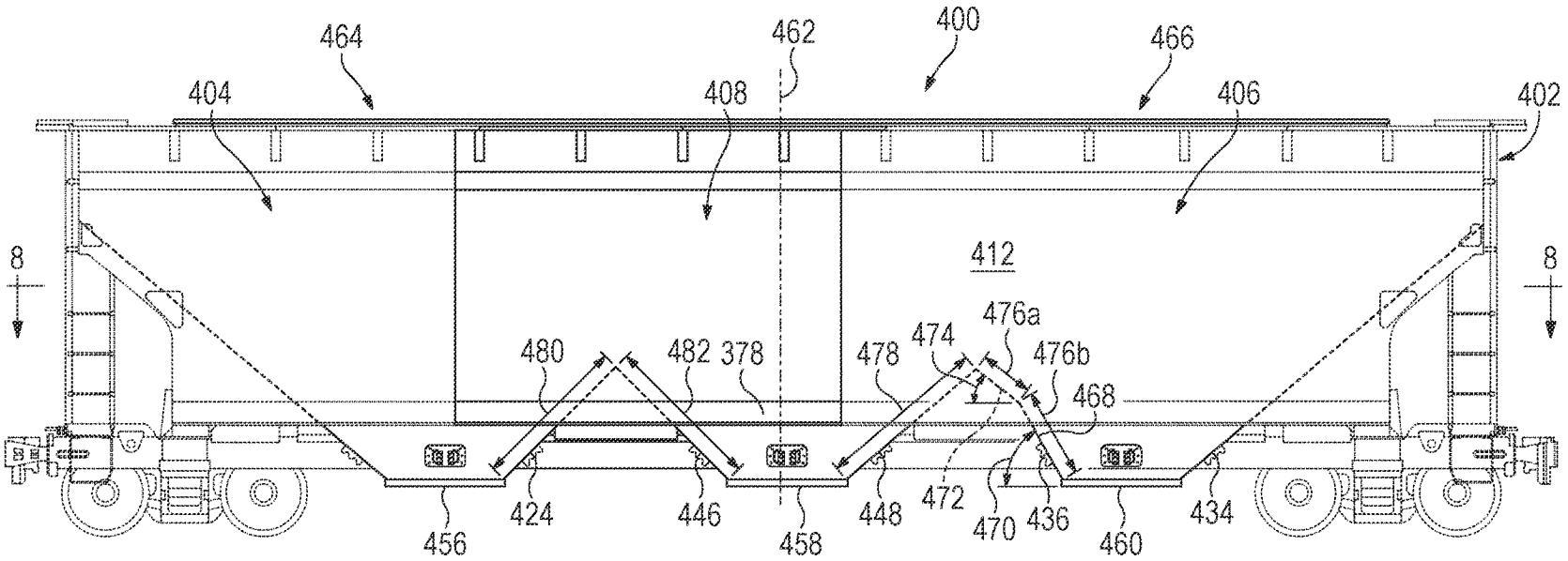
FIG. 7 shows a side view of a further example of an asymmetrical hopper car.
Figure 8:
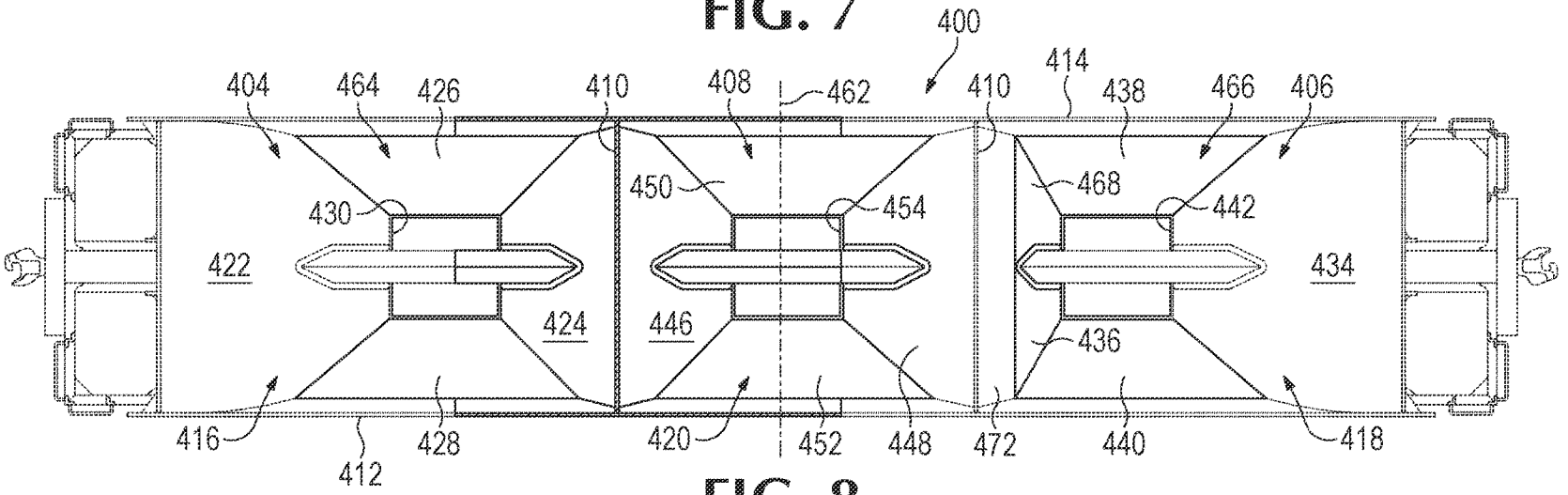
FIG. 8 shows a sectional view of the hopper car of FIG. 7 taken along lines 8-8 in FIG. 7.

Referring to FIGS. 7-8, another asymmetrical covered hopper car 400 is shown. Unless explicitly stated, covered hopper car 400 may include one or more of the same or substantially similar components as one or more of the other covered hopper cars in the present disclosure. Similar to covered hopper cars 200 and 300, hopper car 400 includes three separate cargo hoppers within car body 402, namely two end hoppers 404 and 406 and an intermediate hopper 408 disposed therebetween, and may include the same and/or substantially similar components as hopper cars 200 and/or 300. The volume capacity of hopper car 400 is larger than the volume capacity of hopper cars 200 and 300 (e.g., 4,751 cu. ft. as compared to 4,251 cu. ft.). However, the hopper outlets and associated gates of those hoppers are the same as the hopper outlets and associated gates in hopper car 300. A pair of transversely-extending bulkheads 410 extend between sides 412 and 414, separating cargo hoppers 404, 406, and 408 from each other.

Cargo hoppers 404, 406, and 408 include bottom portions 416, 418, and 420, respectively. Bottom portion 416 of cargo hopper 404 includes an end slope sheet 422, an opposed intermediate slope sheet 424, and opposed transverse sheets 426 and 428, the ends of which collectively define a hopper outlet 430. Similarly, bottom portion 418 of cargo hopper 404 includes an end slope sheet 434, an opposed intermediate slope sheet 436, and opposed transverse sheets 438 and 440, the ends of which collectively define a hopper outlet 442. Additionally, bottom portion 420 includes opposed intermediate slope sheets 446 and 448 and opposed transverse sheets 450 and 452, which collectively define a hopper outlet 454. Gate frames 456, 458, and 460 support and at least partially surround hopper outlets 430, 442, and 454.

Similar to covered hopper car 300, when covered hopper car 400 is divided mid-way or halfway along its length, such as via an imaginary transverse center plane 462, hopper car 400 is asymmetrical. For example, volume of cargo that can be carried on a side 464 of transverse center plane 462 is larger than the volume of cargo that can be carried on other side 466 of that plane (e.g., 2,378.5 cu. ft. and 2,372.5 cu. ft., respectively). In the example shown in FIGS. 7-8, side 464 includes end cargo hopper 404 and a substantial portion of intermediate cargo hopper 408, and side 466 includes end cargo hopper 406 and the remaining portion of intermediate cargo hopper 408 (i.e., the portion not on side 462).

Additionally, the geometry of the hopper cars on sides 464 and 466 are asymmetrical to each other. For example, intermediate slope sheet 436 may have two angles of inclination. A substantial part 468 of intermediate slope sheet 436 may have a first angle of inclination 470, and the remainder part 472 of intermediate slope sheet 436 may have a second angle of inclination 474 that is different from first angle of inclination 470. In the example shown in FIGS. 7-8, first angle of inclination 470 (e.g., 60 degrees) is larger than second angle of inclination 474 (e.g., 42 degrees). The second angle of inclination of remainder part 472 may be the same or different than the angles of inclination of the other intermediate slope sheets, namely intermediate slope sheets 424, 446, and 448. For example, the angles of inclination for intermediate slope sheets 424, 446, and 448 are 42, 45, and 45 degrees, respectively.

Moreover, intermediate slope sheets 436 and 448 have lengths 476 and 478, respectively, that are different from each other, such as 5 feet, 5⅝ inches and 6 feet, 5¾ inches, respectively. Length 476 is the sum of lengths **476*a* and 476*b* of substantial part 468 and remainder part 472, respectively (e.g., 1 foot and 10 15/16 inches and 3 feet and 6 feet and 11/16 inches, respectively). One or both lengths 476 and 478 may be larger than lengths 480 and 482 of intermediate slope sheets 424 and 446 (e.g., 5 feet, 11¾ inches and 5 feet, 11¾ inches respectively). In the example shown in FIGS. 7-8**, the angles of inclination of the end slope sheets are the same as each other (e.g., 40 degrees).

Although hopper cars 200, 300, and 400 are shown to include end slope sheets, intermediate slope sheets, and transverse sheets with particular dimensions and/or angles of inclination, other embodiments of asymmetrical hopper cars of the present disclosure may include end slope sheets, intermediate slope sheets, and/or transverse sheets with different dimensions and/or angles of inclination. Additionally, although the center of gravity in hopper cars 200, 300, and 400 are off center and changes the weight balance between the hopper car, there may be no significant imbalance due to the fact that most of the brake components are located the other end (e.g., B-end) of the hopper car, such brake components 280 adjacent to an end 282 and spaced from an opposite end 284 of car body 202 in FIG. 2. Moreover, although hopper cars 200, 300, and 400 have three separate hoppers, other embodiments of the asymmetrical hopper cars of the present disclosure may include four or more separate hoppers.

Figure 9:
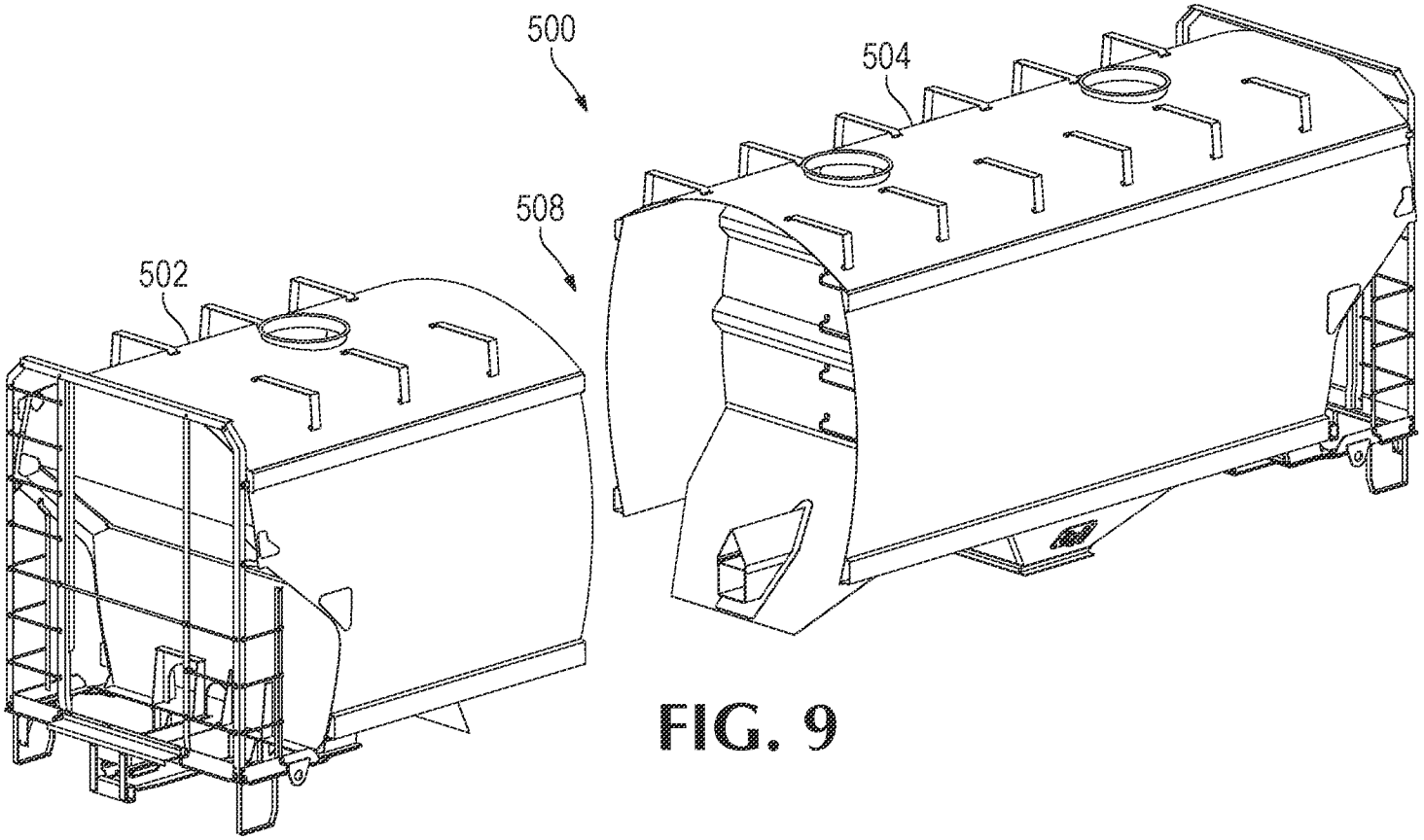
FIG. 9 shows an isometric view of the hopper car of FIG. 1 severed and separated in preparation for building an asymmetrical hopper car having a larger volume.

Referring to FIGS. 9-16, illustrative steps to increase volume capacity of a hopper car 500 (e.g., hopper car 100), such as via converting hopper car 100 to, for example, hopper car 200 or 300, are shown. Unless explicitly stated, covered hopper car 500 may include one or more of the same or substantially similar components as one or more of the other covered hopper cars in the present disclosure. The conversion includes severing the car body of the hopper car, such along a vertical plane as shown at 501 in FIGS. 1-2. Severing the car body forms a first portion 502 and a second portion 504 and those portions are then separated to define a space 508 therebetween, as shown in FIG. 9. Various components are removed or detached from those portions and/or new components are installed, welded, and/or attached, as further discussed below. The dimensions, shapes, and/or compositions of the new components may be the same or different from the components removed or detached.

Figure 10:
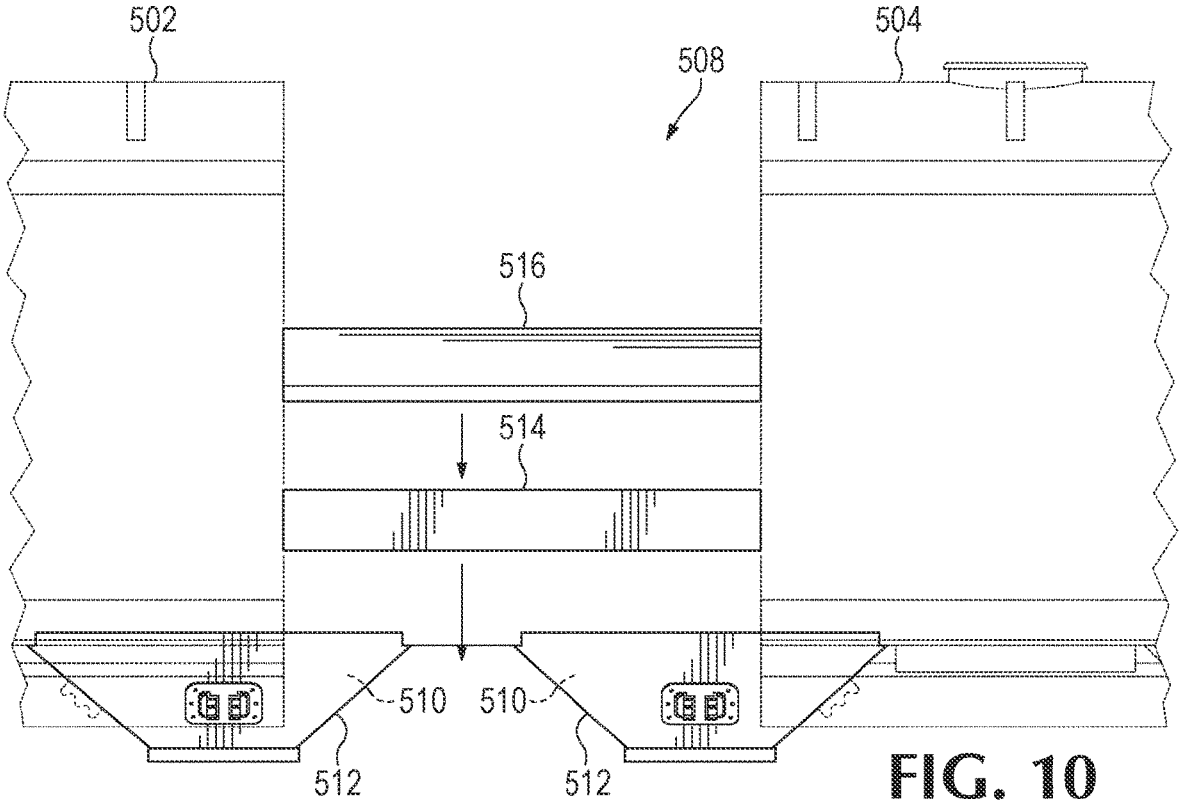
FIGS. 10-15 show side views illustrating various steps in building an asymmetrical hopper car.

Referring to FIG. 10, transverse sheets 510 and gate frames 512 are attached to the first and second portion. Additionally, center sill 514 and center sill hood 516 are attached to the center sill and center hoods of the first and second portions.

Figure 11:
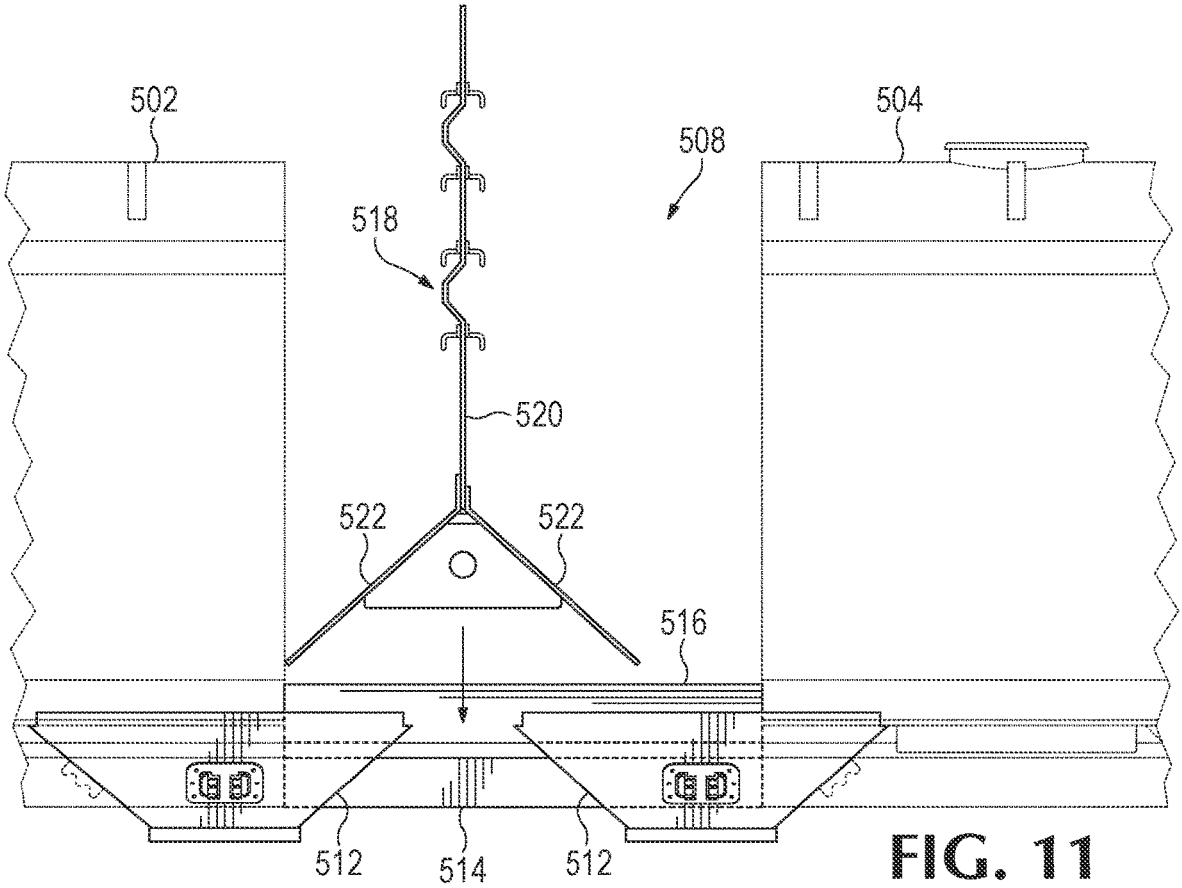
Figure 12:
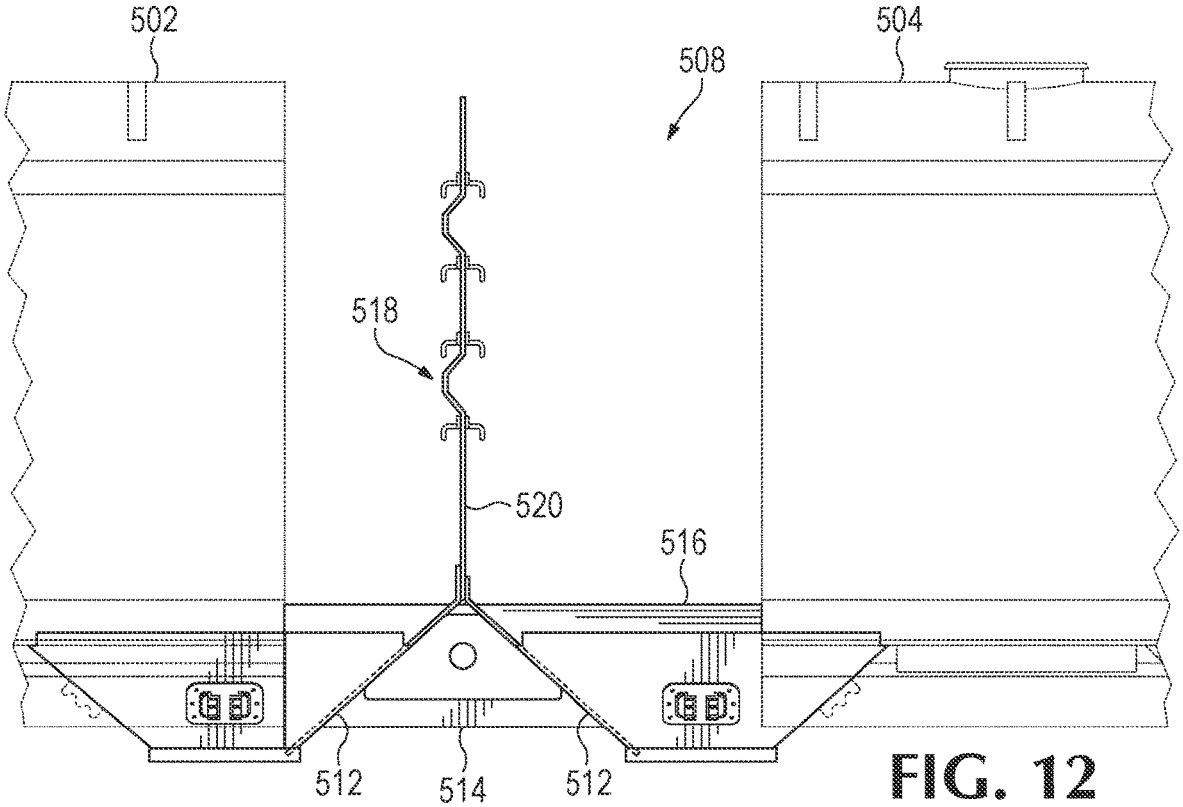

Referring to FIGS. 11-12, bulkhead assembly 518 is installed, which includes a bulkhead 520 and intermediate slope sheets 522. Alternatively, the bulkhead and intermediate slope sheets may be installed separately. The dimensions of the transverse sheets, intermediate slope sheets, and/or gate frames and/or the angles of inclination may be varied based on the desired hopper outlet or gate size.

Figure 13:
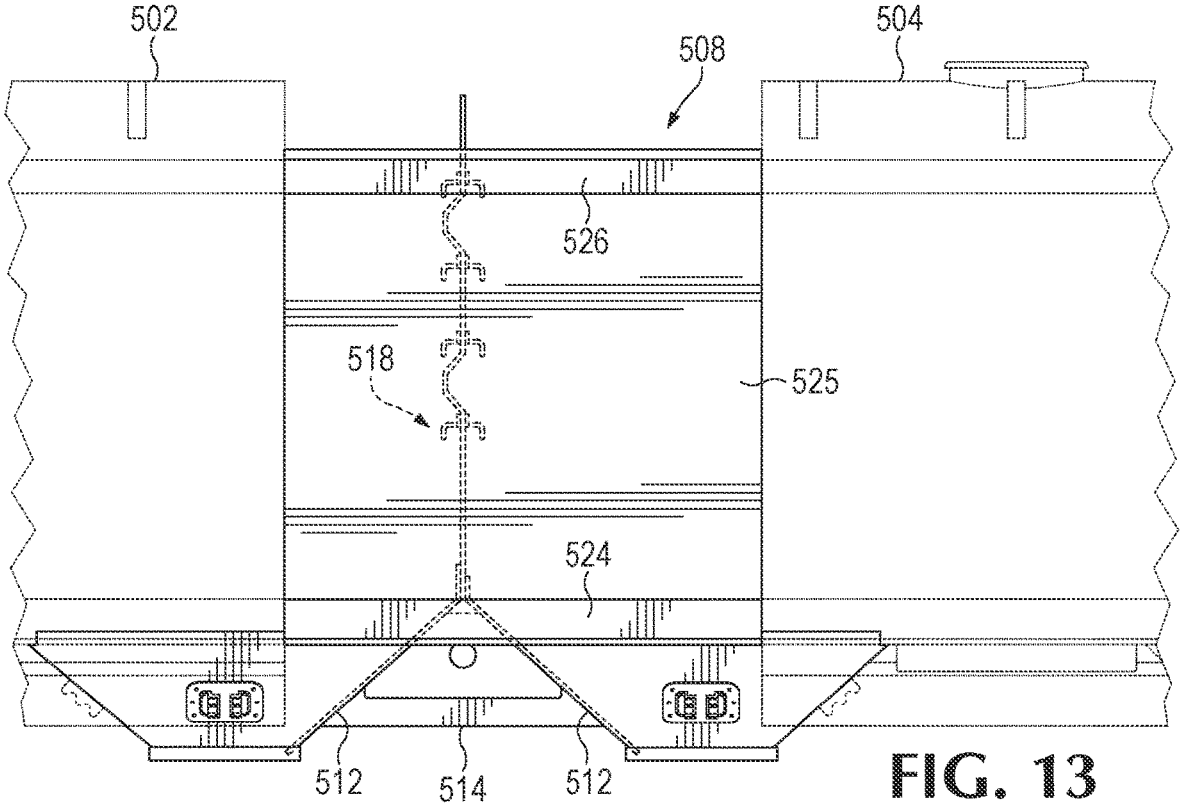
Figure 14:
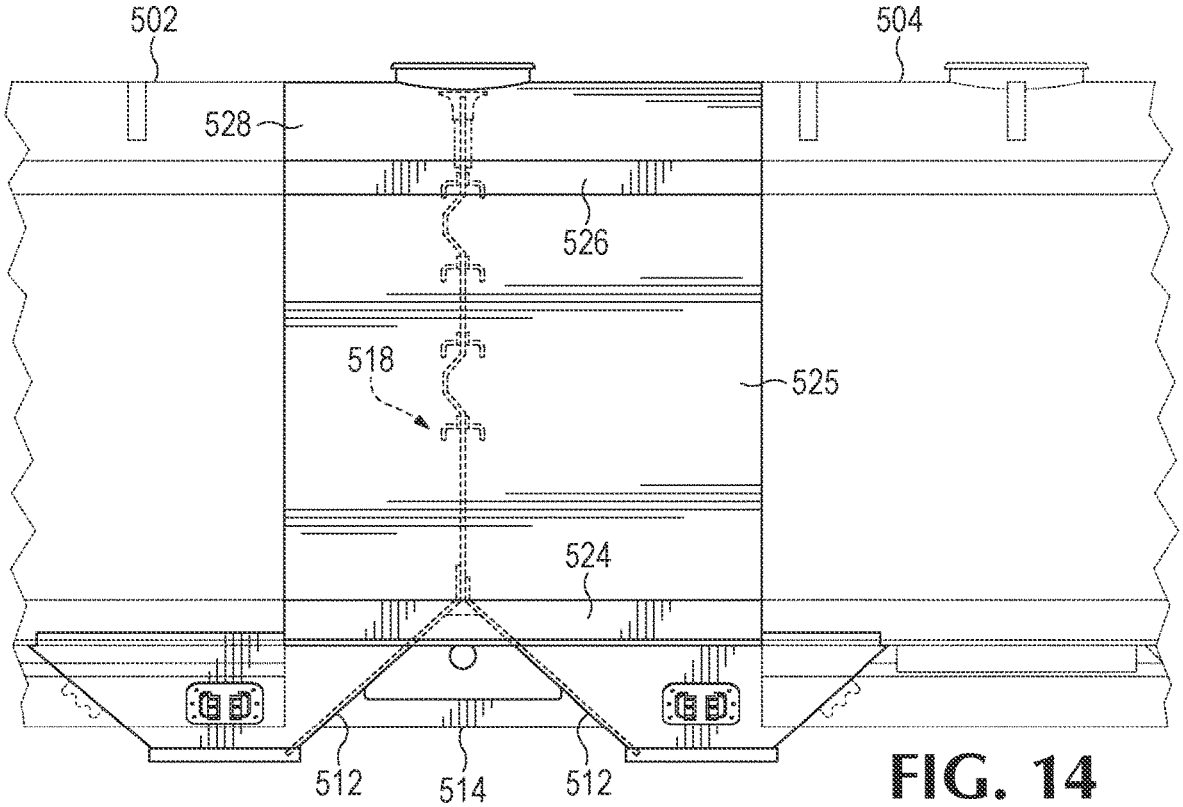
Figure 15:
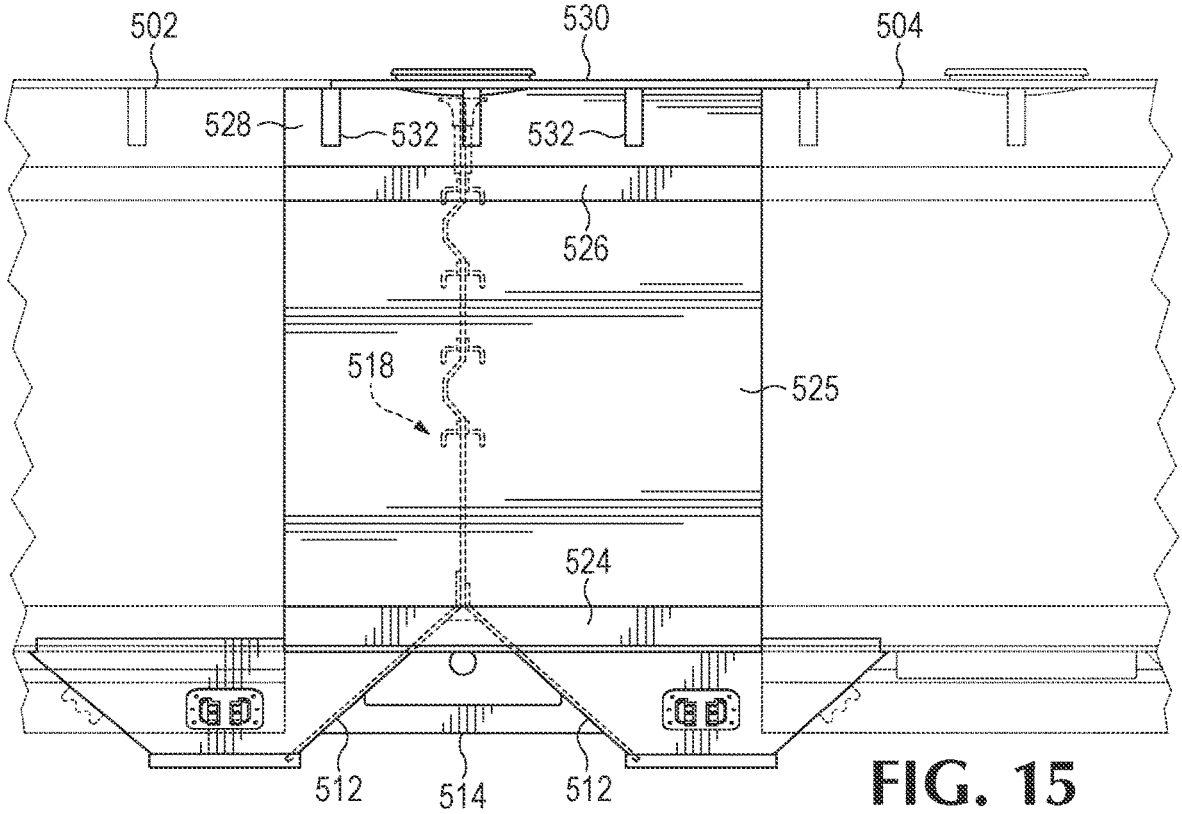
Figure 16:
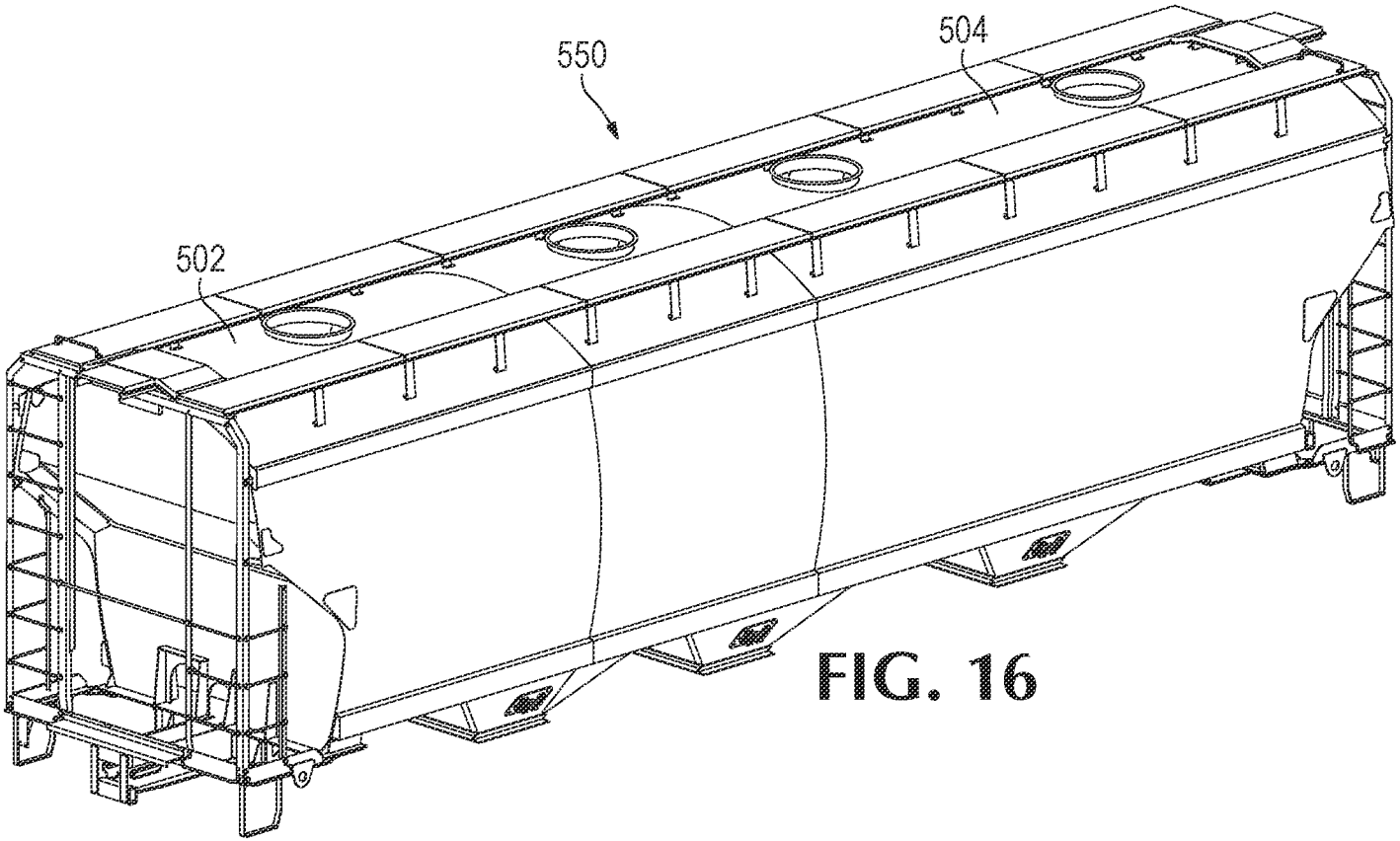
FIG. 16 shows an isometric view of an asymmetrical hopper car built from the steps illustrated in FIGS. 10-15.

Referring to FIGS. 13-16, further steps of the conversion are shown. Side sills 524, side sheets 525, and side plates 526 are installed as shown in FIG. 13. A roof sheet 528 is installed as shown in FIG. 14, and running boards 530 and supports 532 are installed as shown in FIG. 15. The resulting converted hopper car 550 is shown in FIG. 16. Additionally, FIGS. 4 and 6 show in dashed lines which components may be retained from the starting hopper car, and in solid lines which components may be newly installed or attached to result in hopper car 550. Although particular steps are shown in FIGS. 9-16, other embodiments of the method may include steps that are modified, added, repeated, omitted, and/or performed in a different sequence or order.

Referring to FIGS. 9 and 17-23, illustrative steps to increase volume capacity of a hopper car (e.g., hopper car 100), such as via converting hopper car 100 to, for example, hopper car 400, are shown. Unless explicitly stated, the covered hopper car shown in the above figures may include one or more of the same or substantially similar components as one or more of the other covered hopper cars in the present disclosure. The conversion includes severing the car body of the hopper car, such along a vertical plane as shown at 500 in FIGS. 1-2. Severing the car body forms a first portion 502 and a second portion 504 and those portions are then separated to define a space 508 therebetween, as shown in FIG. 9. Various components are removed or detached from those portions and/or new components are installed, welded, and/or attached, as further discussed below. The dimensions, shapes, and/or compositions of the new components may be the same or different from the components removed or detached.

Figure 17:
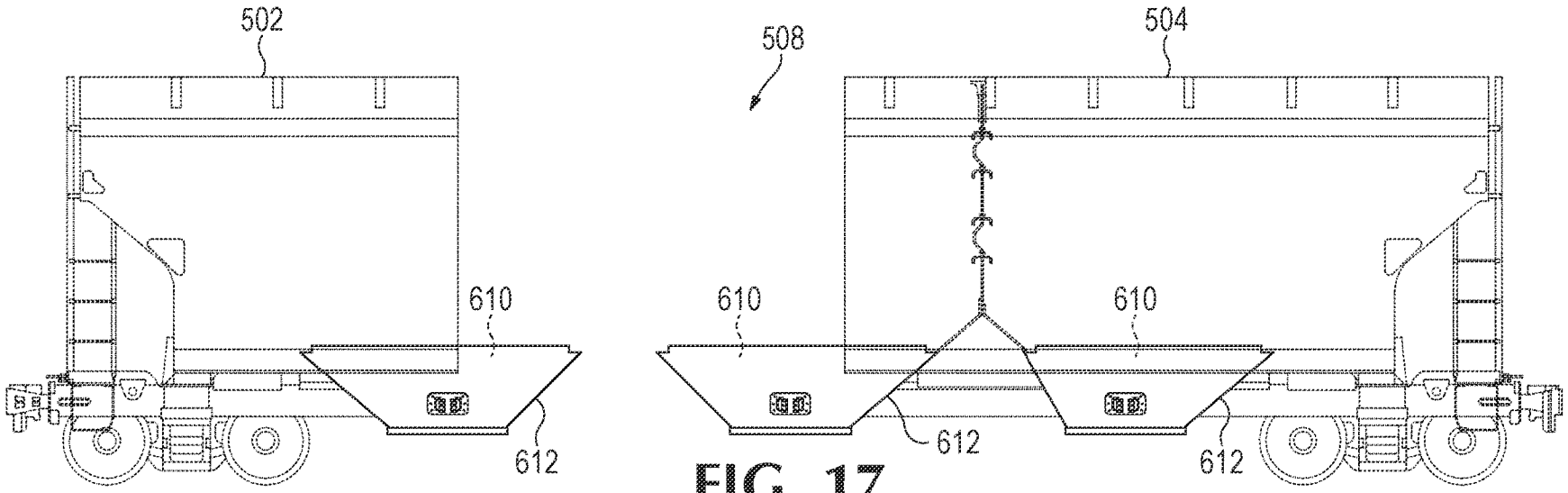
FIGS. 17-22 show side views illustrating various steps in building another asymmetrical hopper car.
Figure 18:
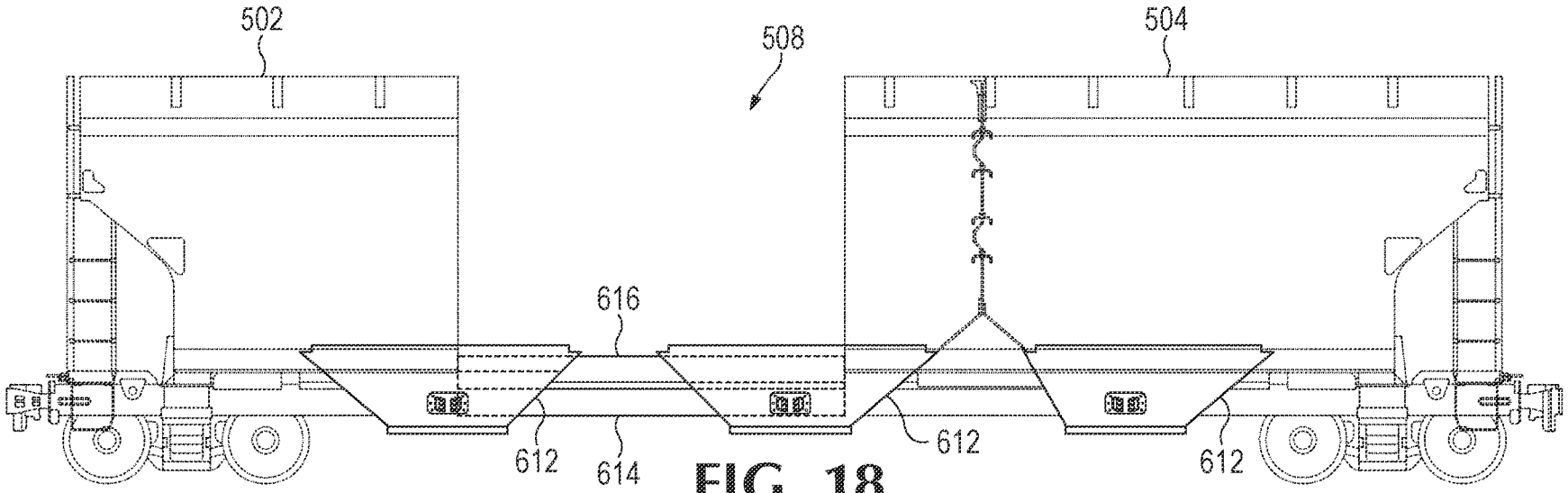

Referring to FIG. 17, transverse sheets 610 and gate frames 612 are attached to the first and second portion. Additionally, center sill 614 and center sill hood 616 are attached to the center sill and center hoods of the first and second portions, as shown in FIG. 18.

Figure 19:
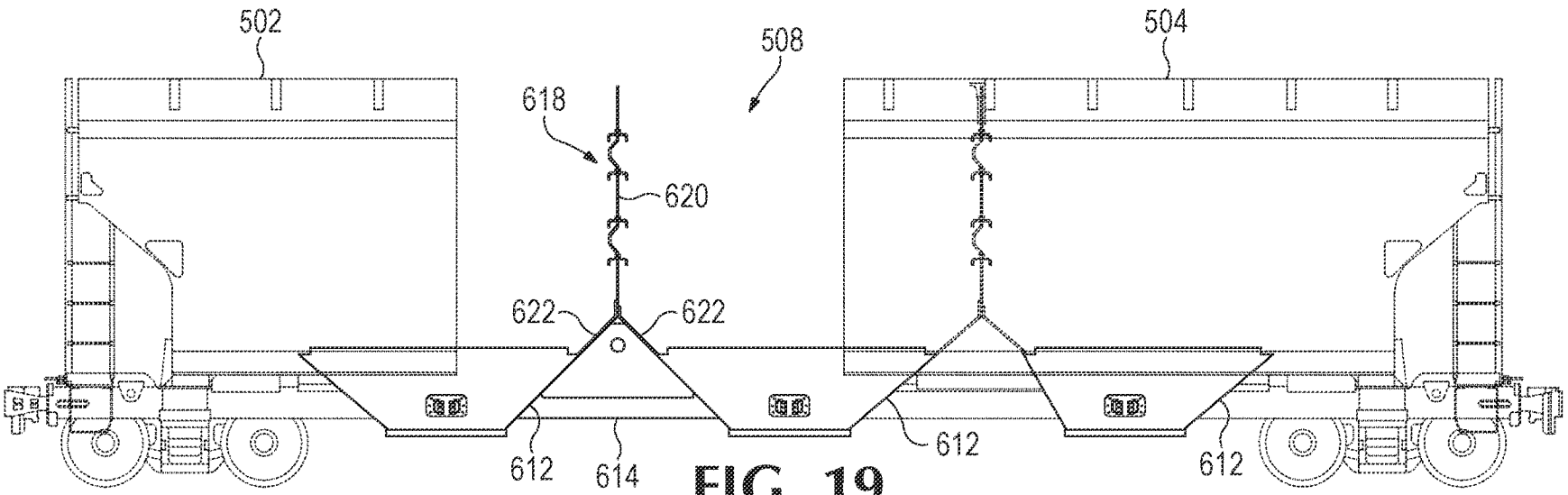

Referring to FIG. 19, bulkhead assembly 618 is installed, which includes a bulkhead 620 and intermediate slope sheets 622. Alternatively, the bulkhead and intermediate slope sheets may be installed separately. The dimensions of the transverse sheets, intermediate slope sheets, and/or gate frames and/or the angles of inclination may be varied based on the desired hopper outlet or gate size.

Figure 20:
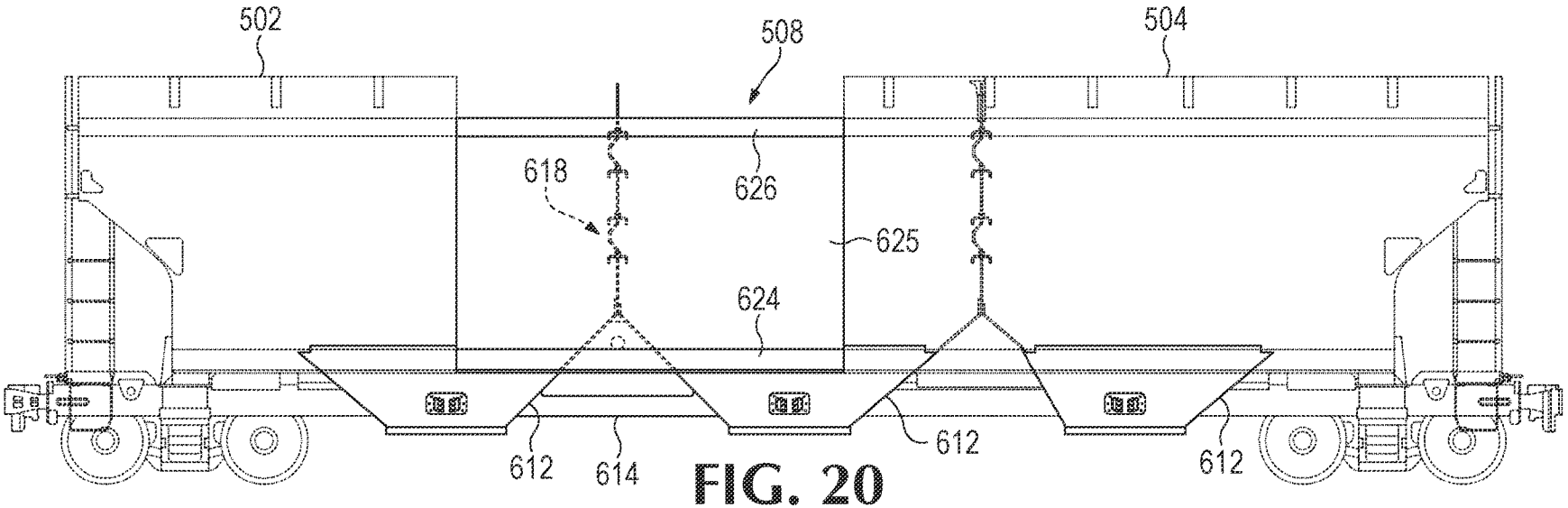
Figure 21:
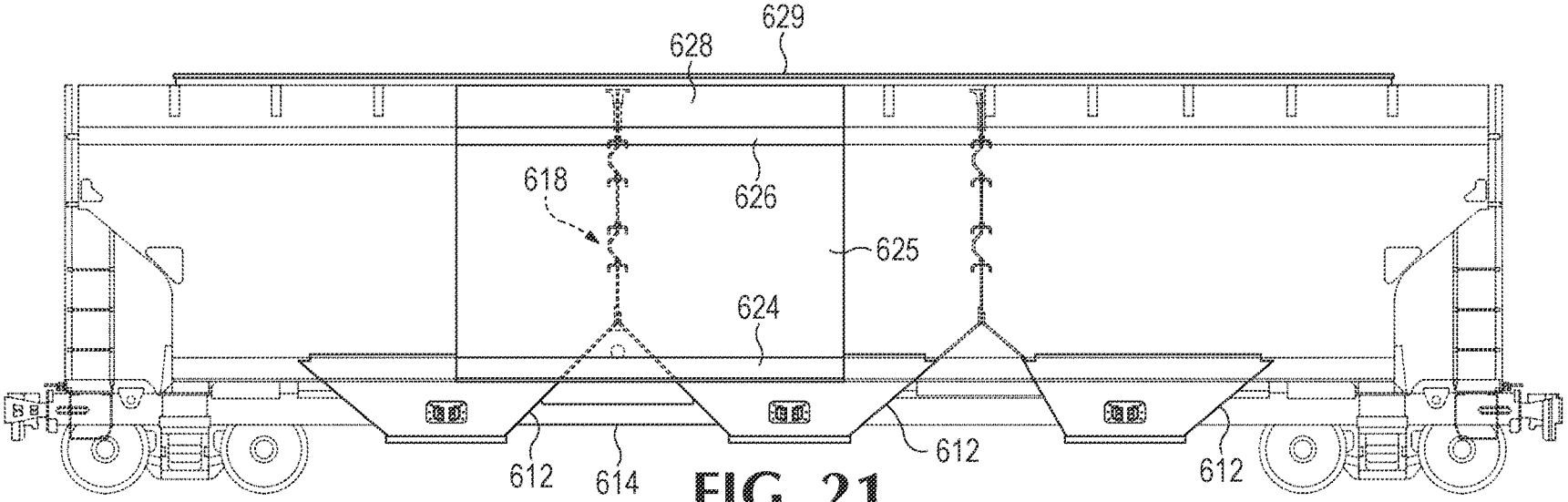
Figure 22:
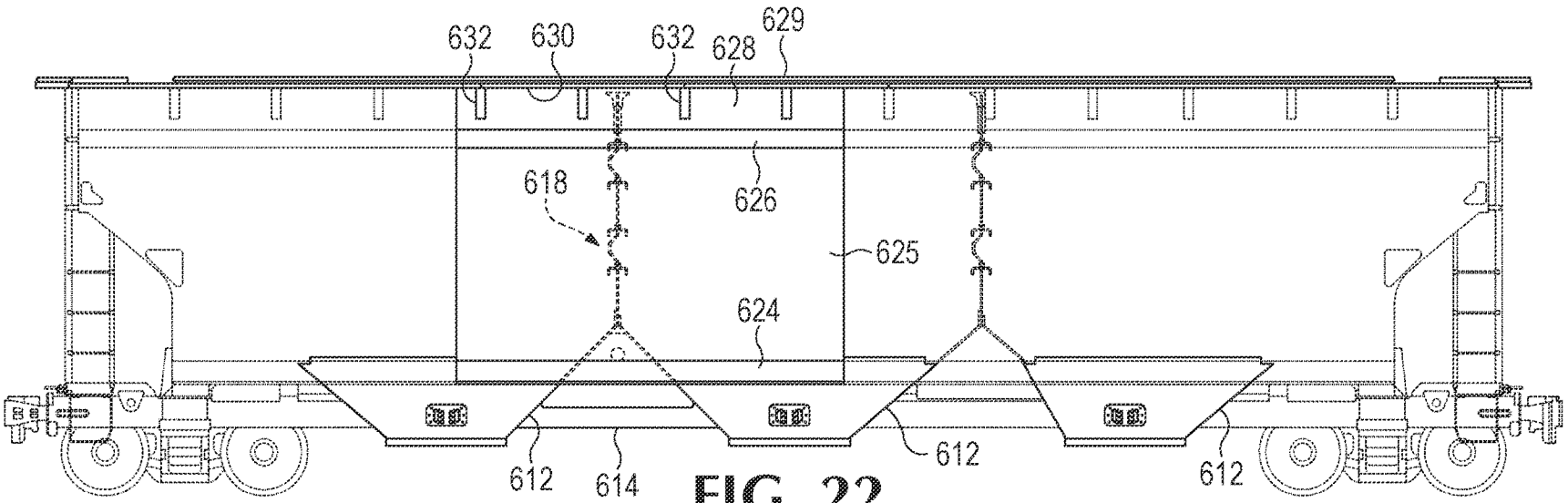
Figure 23:
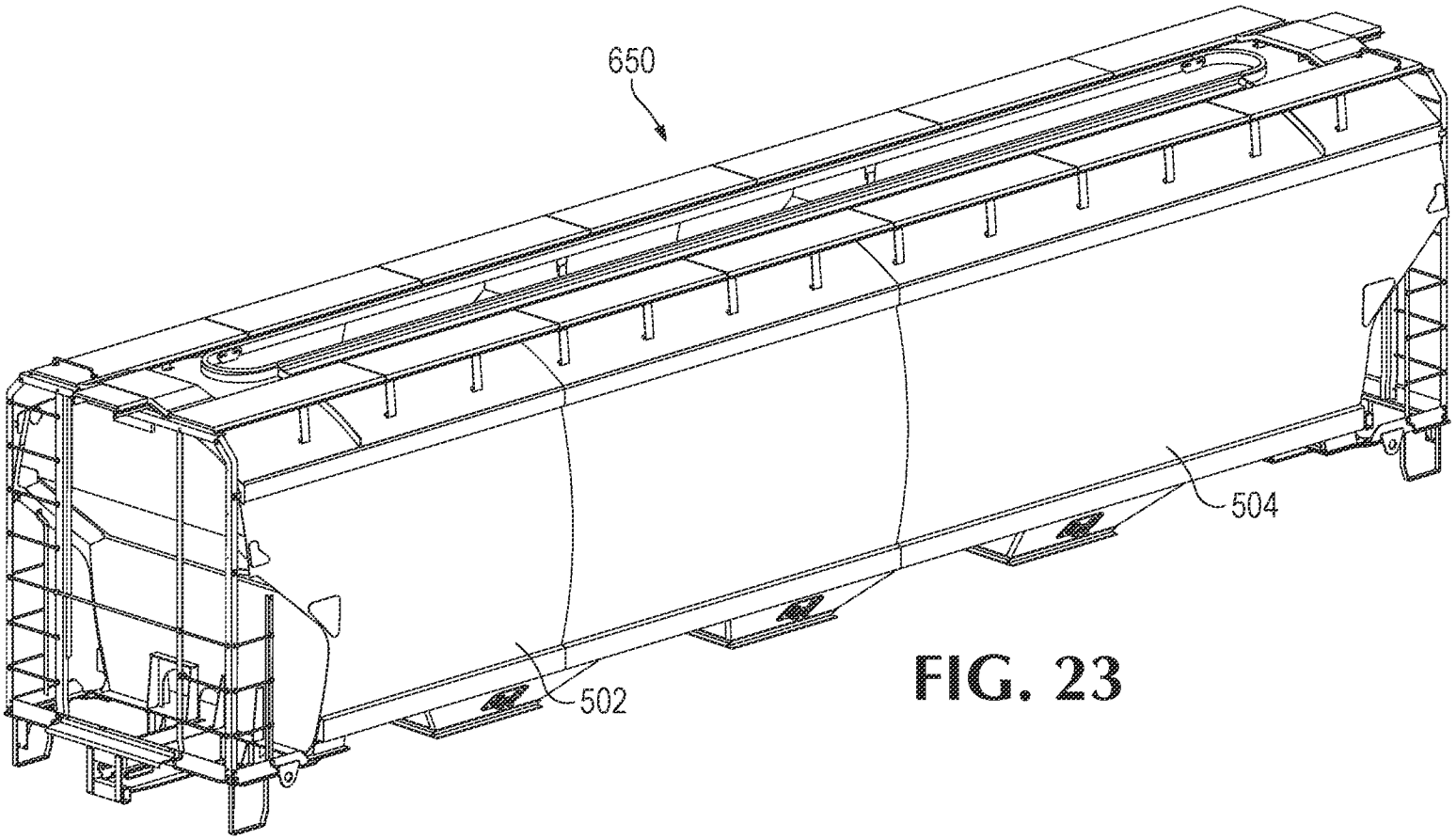
FIG. 23 shows an isometric view of another asymmetrical hopper car built from the steps illustrated in FIGS. 17-22.

Referring to FIGS. 20-22, further steps of the conversion are shown. Side sills 624, side sheets 625, and side plates 626 are installed as shown in FIG. 20. A roof sheet 628 and a trough 629 are installed as shown in FIG. 21 and running boards 630 and supports 632 are installed as shown in FIG. 22. The resulting converted hopper car 650 is shown in FIG. 23. Additionally, FIG. 8 shows in dashed lines which components may be retained from the starting hopper car, and in solid lines which components may be newly installed or attached to result in hopper car 650. Although particular steps are shown in FIGS. 9 and 17-23, other embodiments of the method may include steps that are modified, added, repeated, omitted, and/or performed in a different sequence or order.

Although the methods above disclose the addition of one separate hopper in a two-hopper car, other embodiments of the methods may include the addition of two or more separate hoppers in a two-hopper car or the addition of one or more separate hoppers in a three or more hopper car.

One of the many advantages provided by the present disclosure is that the above methods reduce the amount of labor and material needed to convert the hopper car. In contrast, if car symmetry were maintained while increasing hopper car volume, additional components would be required, e.g., two new intermediate bulkhead assemblies would be needed instead of one. This would result in additional material cost in the form of thousands of pounds of extra steel, as well as lots of increased labor to install the components and materials.

It will be appreciated that the invention is not restricted to the particular embodiment that has been described, and that variations may be made therein without departing from the scope of the invention as defined in the appending claims, as interpreted in accordance with principles of prevailing law, including the doctrine of equivalents or any other principle that enlarges the enforceable scope of a claim beyond its literal scope. Unless the context indicates otherwise, a reference in a claim to the number of instances of an element, be it a reference to one instance or more than one instance, requires at least the stated number of instances of the element but is not intended to exclude from the scope of the claim a structure or method having more instances of that element than stated. The word "comprise" or a derivative thereof, when used in a claim, is used in a nonexclusive sense that is not intended to exclude the presence of other elements or steps in a claimed structure or method.

What is claimed is:

1. A railroad hopper car, comprising:

(a) a car body having a pair of opposed sides and a pair of opposed ends defining a length;

(b) a pair of wheeled trucks supporting the car body, each of the trucks being located adjacent a respective one of the pair of opposed ends;

(c) two or more spaced bulkheads extending between the pair of opposed sides to define three or more separate hoppers arranged adjacent one another along the length of the car body and between the pair of side walls; and (d) the hoppers being longitudinally asymmetric such that total volume of the hoppers on one side of a transverse center plane of the car body is different from total volume of the hoppers on the other side of the transverse center plane, wherein the total volume of the hoppers on one side of the transverse center plane of the car body is greater than the total volume of the hoppers on the other side of the transverse center plane, and further comprising one or more brake components mounted to the car body and supported on one of the pair of wheeled trucks, the one or more brake components being located on the other side of the transverse center plane, wherein weight of the one or more brake components prevents weight imbalance of the railroad hopper car caused by the greater total volume of the hoppers on the other side of the transverse center plane.

2. The railroad hopper car of claim 1, wherein the hoppers include a first end hopper, a second end hopper, and one or more intermediate hoppers therebetween, wherein the first end hopper includes a first bottom portion that includes a first end slope sheet, a first intermediate slope sheet, a first transverse sheet, and a second transverse sheet, the first end slope sheet and the first intermediate slope sheet being opposed to each other, and the first and second transverse sheets being opposed to each other, and wherein the second end hopper includes a second bottom portion that includes a second end slope sheet, a second intermediate slope sheet, a third transverse sheet, and a fourth transverse sheet the second end slope sheet and the second intermediate slope sheet being opposed to each other, and the third and fourth transverse sheets being opposed to each other.

3. The railroad hopper car of claim 2, wherein the first and second end slope sheets have angles of inclination that are same as each other, and at least a substantial portion of the first and second intermediate slope sheets have angles of inclination that are different from each other.

4. The railroad hopper car of claim 3, wherein the one or more intermediate hoppers include a third hopper having a third bottom portion that includes opposed third and fourth intermediate slope sheets and opposed fifth and sixth transverse sheets.

5. The railroad hopper car of claim 4, wherein the third and fourth intermediate slope sheets have angles of inclination that are different from each other.

6. The railroad hopper car of claim 4, wherein the third and fourth intermediate slope sheets have angles of inclination that are same as each other.

7. The railroad hopper car of claim 4, wherein the first and third intermediate slope sheets have angles of inclination that are same as each other.

8. The railroad hopper car of claim 4, wherein the first intermediate slope sheet includes a first portion and a second portion, the first portion being substantially longer than the second portion, wherein the first portion and the second portion have angles of inclination that are different from each other, and wherein the first portion and the third intermediate slope sheet have angles of inclination that are different from each other.

9. The railroad hopper car of claim 8, wherein the second portion and the third intermediate slope sheet have angles of inclination that are same as each other.

10. The railroad hopper car of claim 4, wherein the first, second, third, and fourth intermediate slope sheets have substantially equal lengths.

11. The railroad hopper car of claim 4, wherein the first and third intermediate slope sheets have lengths that are greater than the lengths of the second and fourth intermediate slope sheets.

12. The railroad hopper car of claim 2, wherein the first and second end slope sheets have angles of inclination that are same as each other, and the first and second intermediate slope sheets have angles of inclination that are same as each other.

* * * * *